US005967358A

United States Patent [19]

Adams et al.

[11] Patent Number: 5,967,358

[45] Date of Patent: Oct. 19, 1999

[54] TANK FILLING AND PRESSURE RELIEF ASSEMBLY

[75] Inventors: David J. Adams; Charles A. Betts, both of Warren, Pa.

[73] Assignee: Betts Industries, Inc., Warren, Pa.

[21] Appl. No.: 09/099,843

[22] Filed: Jun. 19, 1998

Related U.S. Application Data

[60] Provisional application No. 60/049,943, Jun. 19, 1997.

[51] Int. Cl.[6] ..... F16K 17/10; F16K 17/36

[52] U.S. Cl. ..... 220/203.09; 220/203.27; 220/314; 220/315; 137/43; 137/347; 137/588; 251/86; 292/256.5; 105/377.05

[58] Field of Search ..... 220/203.09, 203.04, 220/203.23, 203.27, 203.29, 581, 582, 314, 315, 324, 326, 810, 833, 835, 848, 849; 105/377.05, 377.07, 377.08, 377.11; 292/256.5; 137/347, 588, 542, 43; 251/86

[56] References Cited

U.S. PATENT DOCUMENTS

| | | | |
|---|---|---|---|
| 3,339,791 | 9/1967 | De Frees . | |
| 4,181,238 | 1/1980 | Arnold et al. . | |
| 4,294,378 | 10/1981 | Rabinovich . | |
| 4,501,377 | 2/1985 | Palmer, III . | |
| 4,555,041 | 11/1985 | Muehl | 137/43 X |
| 4,622,902 | 11/1986 | Miller . | |
| 5,048,553 | 9/1991 | VanDeByvere | 137/43 |
| 5,246,027 | 9/1993 | Morris | 137/43 |
| 5,511,575 | 4/1996 | Andenmatten et al. | 220/203.27 X |
| 5,673,897 | 10/1997 | Crochet et al. . | |

OTHER PUBLICATIONS

Data Sheet of Betts Industries, Inc., Tiona 20" PAF 406–96 Offset Manhole, Aug., 1996.

Data Sheet of Betts Industries, Inc., Parts List—20" PAF 406–96 Manhole, May, 1997.

*Primary Examiner*—Stephen K. Cronin
*Assistant Examiner*—Nathan Newhouse
*Attorney, Agent, or Firm*—James C. Simmons

[57] ABSTRACT

A tank filling and pressure relief assembly. A cover member has a seat for sealingly closing the tank opening. A stem is attached at one end to a piston in a cylinder (which is attached to the cover member and extends downwardly therefrom into the tank) and at the other end to a strongback. The strongback is pivotly mounted to swing the assembly away from the opening for filling thereof and to swing the assembly back into position to seat the cover member and is lockable in a position to lockingly urge the cover member to the closed position. The stem is flexibly coupled to the strongback to evenly distribute the seating force so that binding does not occur and is threadedly attached thereto so that the set pressure for pressure relief may be adjusted by access to the stem for turning thereof through an opening or cut-out in the strongback.

20 Claims, 9 Drawing Sheets

TANK FILLING AND PRESSURE RELIEF ASSEMBLY

Priority of co-pending U.S. provisional patent application serial number 60/049,943, filed Jun. 19, 1997, is hereby claimed. This application is hereby incorporated herein by reference.

The present invention relates generally to filling and pressure relief assemblies for tanks such as, for example, gasoline truck tanks.

Manhole assemblies are typically provided to such tanks wherein a fill cover is openable by means of a strongback to which the cover is rigidly connected to allow a tank to be filled and wherein a pressure activated emergency relief vent is operable when the cover is closed. Such assemblies may be referred to as PAFs (pressure activated fill). The cover carries a gasket for sealing against a seating surface of a closure assembly. The vent assembly is required to hold a set pressure of, for example, 3.625 psi. The set pressure is the tank pressure at which leakage through the assembly occurs. The set pressure is determined by the compression force of a spring. The spring is mounted in a cylinder between a lower plug member and an upper piston, and the cylinder is attached to the fill cover for movement therewith. When the force exerted by the tank pressure on the fill cover becomes greater than the spring compressive force, the fill cover opens to release excess pressure. The position of the piston within the cylinder when the closure assembly is closed determines the spring compressive force and thus determines the set pressure. Betts Industries, Inc. of Warren, Pa, the assignee of the present invention, provides such an assembly known as a Tiona 20" PAF 406-96 offset manhole.

The set pressure in such assemblies may fluctuate, and some such assemblies may not hold the required set pressure due to inadequate sealing between the cover and the closure assembly.

Moreover, in some PAFs the set pressure is not adjustable, but is designed into the fit and tolerance of the assembled parts. If there is wear or if there is variation in the collar which is welded into the tank, the PAF may not function properly. In other PAFs the set pressure is adjustable by inconveniently opening the fill cover and operating an adjusting bolt at the bottom of the cylinder.

Art which may be of interest to this application includes U.S. Pat. Nos. 4,622,902; 3,339,791; 4,501,377; 4,181,238; 5,673,897; and 4,294,378. U.S. Pat. No. 4,622,902 discloses a cover for a manhole in a hopper car which is shown to be loosely mounted to a locking bar at a slide assembly. The slide assembly and a slot for the hinge bolt are said to allow the cover to seat against the manhole without binding. Such a direct coupling of the cover and locking bar does not provide for pressure release as contemplated by the present invention.

U.S. Pat. No. 3,339,791 discloses an emergency venting means for a tank car manhole that includes a bolt 37 which is turned to preload spring 36. Turning of the bolt adjusts or preloads the cover 27 which is forced onto opening 11. Thus, the pressure at which the cover will open to relieve pressure is adjustable by access to head of bolt 37 in well 25 the inlet to which is from lock arm 18. Such a construction undesirably leaves the spring well open to the weather.

It is accordingly an object of the present invention to provide improved sealing of the cover to the closure assembly.

It is another object of the present invention to provide for set pressure adjustment easily, without the necessity of opening the fill cover.

In order to provide improved sealing of the cover to the closure assembly, in accordance with the present invention, the cover is connected to one end portion of an elongate member or stem and the strongback is connected to the other end portion of the stem by a flexible coupling which allows the cover and the gasket to adjust to and better seat against the seating surface of the closure assembly. The provision of the stem also allows adjustment of spring force for excess pressure relief by extending of the stem beyond the cover for attachment to a piston and rotation of the stem from a position of access above the assembly for adjusting the spring force easily, i.e., without opening the fill cover.

In order to provide for set pressure adjustment easily, in accordance with the present invention, a stem or elongate member to which a piston is attached is threadedly received within a threaded aperture in a flexible coupling member for raising and lowering the stem and thus raising and lowering the piston within the cylinder by rotating the upper end of the stem, whereby it is unnecessary to open the fill cover. The piston is attached to the stem so that it does not rotate with the stem. The cylinder extends from the cover into the tank so that the spring well is protected from the weather by the cover.

The above and other objects, features, and advantages of the present invention will be apparent in the following detailed description of the preferred embodiment when read in conjunction with the accompanying drawings wherein the same reference numerals denote the same or similar parts throughout the several views.

IN THE DRAWINGS

DETAILED DESCRIPTION OF THE PREFERRED EMBODIMENT

Figure 4:
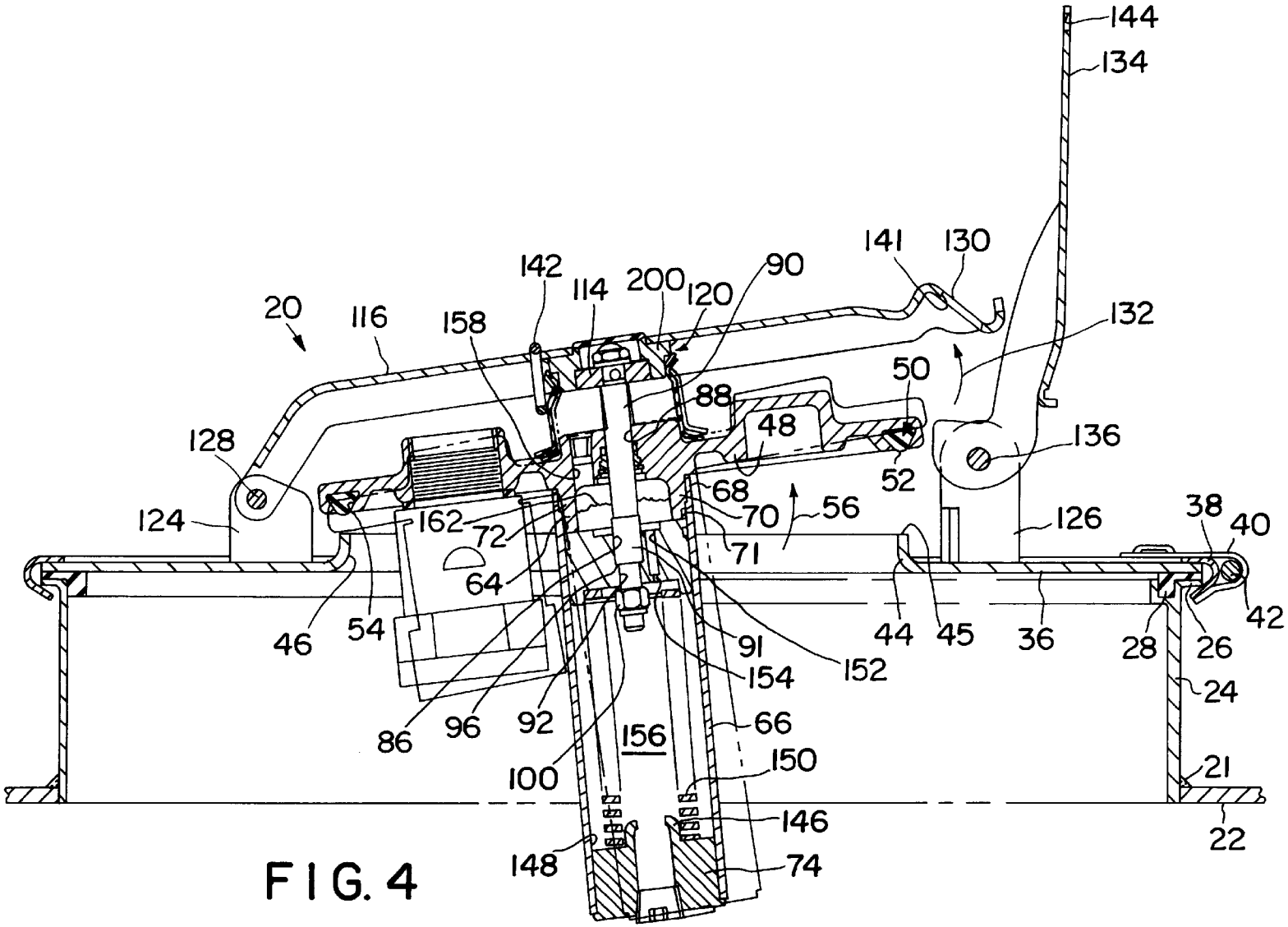
FIG. 4 is a view similar to that of FIG. 1 illustrating opening of the assembly for filling.

Referring to the drawings, there is shown generally at 20 a fill and relief vent manhole assembly which is installed in an upper opening of a tank, illustrated at 22, by means of a manhole collar 24 which is welded as by weld 21 to the tank along the perimeter of a tank opening. The collar 24 may be composed of steel, aluminum, stainless steel, or other suitable material. While the collar is understood to be uniform in size and shape about its circumference, it is illustrated on the left side of FIGS. 1 and 4 as a relative thin steel or stainless steel collar and on the right side as alternatively a relatively thick aluminum collar, and its upper edge is illustrated with two alternative shapes respectively.

As is commonly known in the art, apparatus according to the present invention can be made to various dimensions and other specifications, which will vary depending on sizes and other requirements, and one of ordinary skill in the art can devise suitable apparatus using the description contained herein.

The upper edge of the collar 24 has an outwardly extending flange 26. A circular gasket 28 has a horizontal portion 32 which engages the flange 26 and a vertical portion 34 which engages an inner wall of the collar 24. In the embodiment on the right side in FIGS. 1 and 4, the upper edge portion of the collar 24 is formed to have a groove, illustrated at 30, in which the vertical portion 34 is received.

The outer edge portion of a circular plate 36 sealingly engages the upper surface of the gasket 28 and is clampingly attached to the collar 24 by a clamp ring 38. After the clamp ring 38 is positioned circumferentially to engage the collar flange 26 and edge portion of the circular plate 36, lugs 40 on the clamp ring ends are brought together by bolt or screw 42 to tightly and sealingly attach the plate 36 to the collar 24.

Figure 18:
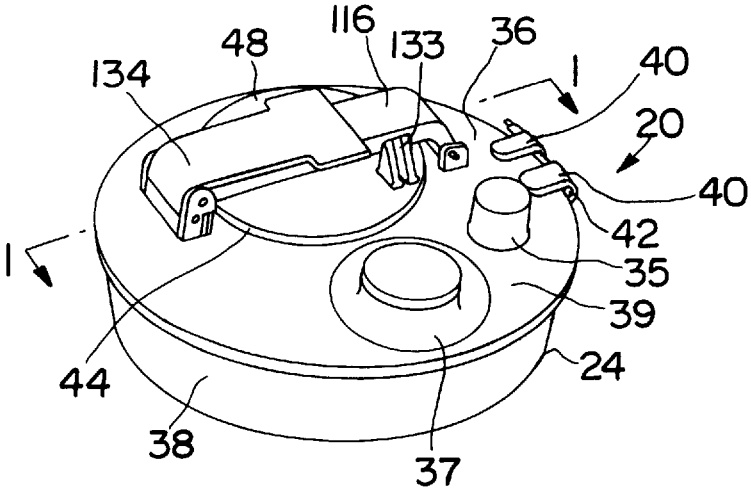
FIG. 18 is a perspective view of the filling and pressure relief assembly.

By removing the clamp ring 38, the assembly may be easily removed to gain entrance to the tank 22 through the manhole provided by collar 24. Illustrated at 35 and 37 in FIG. 18 are optional devices, for example, a "normal" vent and a vapor recovery vent respectively, which may be mounted in the plate 36. A plug, illustrated at 39, which allows installation of a pressure gage, may also be installed in the plate 36.

The plate 36, which may be, for example, composed of steel or stainless steel, has a circular inner edge portion which is suitably formed to define a flange 44 which extends upwardly from the plane of the plate 36 to provide a seating surface 45, and to define an opening, illustrated at 46, through which the tank 22 may be filled when the assembly 20 is opened, as hereinafter discussed. The fill opening 46 may have a diameter of, for example, 10 inches.

Figure 1:
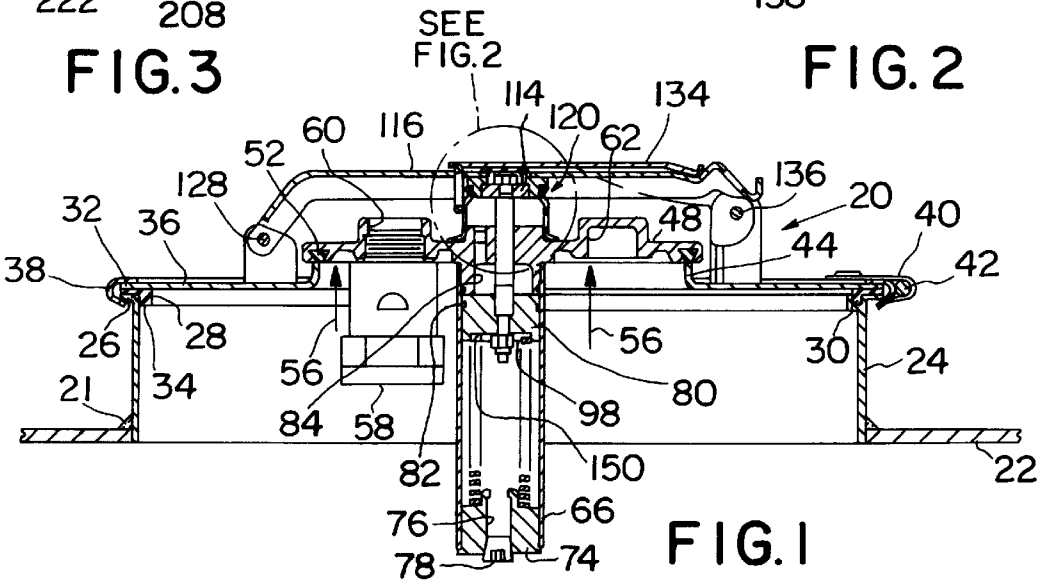
FIG. 1 is a sectional view, taken along lines 1—1 of FIG. 18, of a filling and pressure relief assembly which embodies the present invention.

A circular cover 48 which may, for example, be composed of aluminum, for the opening 46 has a recess, illustrated at 50, in the lower surface of its outer edge. A circular gasket 52 is received in the recess, which has a narrowed throat 54 for retaining the gasket 52 therein. The gasket 52 is positioned to sealingly engage the seating surface 45 of the closure plate flange 44 to thereby sealingly close the opening 46. As can be seen in FIG. 1, excessive pressure in the tank 22 will act against the cover 48, as illustrated at 56, to lift it and thereby vent or relieve the excessive pressure in an emergency. A conventional "normal" vent, illustrated at 58, is suitably installed in an opening, illustrated at 60, in the cover 48 to allow in and out "breathing" to the tank 22. The cover is formed to have a recess, illustrated at 62, in its lower surface so that an opening may be cut in the cover, as illustrated for "normal" vent 58, at the bottom of the recess and a second "normal" vent similarly installed if desired.

The central portion of the cover 48 is formed to have a downwardly extending neck portion 64 which is received in the upper end portion of a cylinder 66 and is fixedly attached thereto such as by threads at 72 to close the upper end of the cylinder. The cylinder 66 thus moves vertically as the cover 48 moves vertically. The upper end portion 68 of the cylinder 66 is narrowed to define an inner shoulder 70. The neck portion 64 extends downwardly beyond the shoulder 70 and has a cylindrical groove in its outer surface in which is received an o-ring 71 to create a seal between cover 48 and cylinder 66.

A plug member 74 is received in and is welded or otherwise suitably attached to the lower end portion of the cylinder 66 to sealingly close the lower end portion of the cylinder. The plug member 74 has a central opening, illustrated at 76, to the cylinder, and this opening 76 is sealingly closable by a suitable plug 78.

A piston 80 is received within the cylinder 66 for relative vertical movement between the piston and cylinder. The cylinder and piston may, for example, be composed of aluminum. A piston ring 82, received in circumferential groove 81, provides a seal between the piston and cylinder.

The neck portion 64 is configured to define a central hole, illustrated at 84, therein. The piston 80 and cover central portion have apertures, illustrated at 86 and 88 respectively, extending therethrough in which is received an elongate stem 90. The lower end portion 92 of aperture 86 has a reduced diameter, and the stem 90 has a corresponding reduced diameter lower portion 94 defining a shoulder 96 which engages a piston shoulder defined by the reduced diameter portion 92. The stem 90 has an increased or larger stepped diameter portion 91 which extends from the shoulder 96 to slightly above the piston 80 for providing increased bearing surface between the piston and the shoulder 96. The lower surface of piston 80 has a central circular recess 98 therein. The lower end portion of the stem 90 is threaded and receives a nylon insert locknut 100 which is tightened down to and bottoms on shoulder 97 which is at the upper end of a notched thread relief section 99. A small gap, illustrated at 101, of, for example, about 0.02 inch, is thereby created between the lower end of the piston 80 and the tightened down nut 100 so as to allow the stem 90 to rotate independently of the piston 80 during adjustment of the set pressure (while vertical thrust is still supported through the components), as discussed hereinafter.

The cover member 48 is vertically movable along the stem 90. The circular cover member surface which defines the aperture 88 has a circular recess therein which receives a sealing o-ring 102. An adjacent recess receives an insert 104 for maintaining the o-ring position and shape. The insert 104 is held in position by a retaining ring 106.

The stem 90 has a reduced diameter upper end portion 108 which defines a shoulder 110. This upper end portion 108 is received in a central aperture, illustrated at 112, in a member 114 which is part of an assembly, illustrated generally at 120, which is welded or otherwise suitably attached to the central portion of an elongate strongback 116 and which is described in greater detail hereinafter. The upper end portion 108 of the stem is threaded and receives a star washer 118 and nut 122. Accordingly, the stem 90, strongback 116, and piston 80 move as a unit, and the cover 48 and cylinder 66 as well as plug member 74 move as a unit.

A pair of brackets 124 and a pair of brackets 126 are welded or otherwise suitably attached to the plate 36 on diametrically opposite sides thereof. One end portion of the strongback or lever 116 is pivotally attached as by pivot rod 128 to brackets 124. By lifting the other or free end portion 130 of the lever 116, the cylinder 66 and cover 48 may be lifted or swung upwardly and out of the way, as illustrated at 132 in FIG. 4, so that the tank 22 may be filled with, for example, gasoline.

Figure 20:
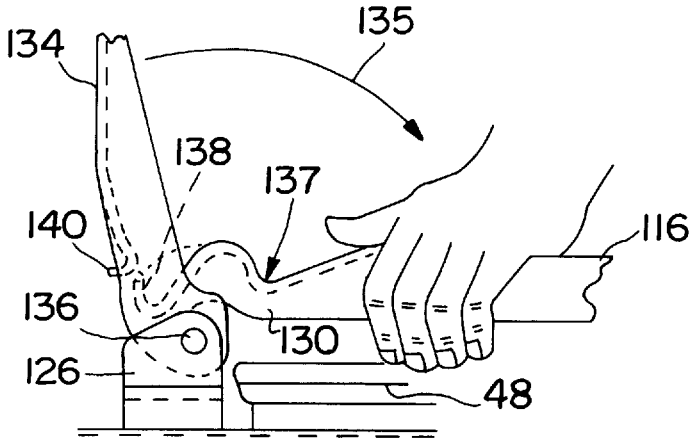
FIG. 20 is a schematic view illustrating closing of the filling and pressure relief assembly.
Figure 7:
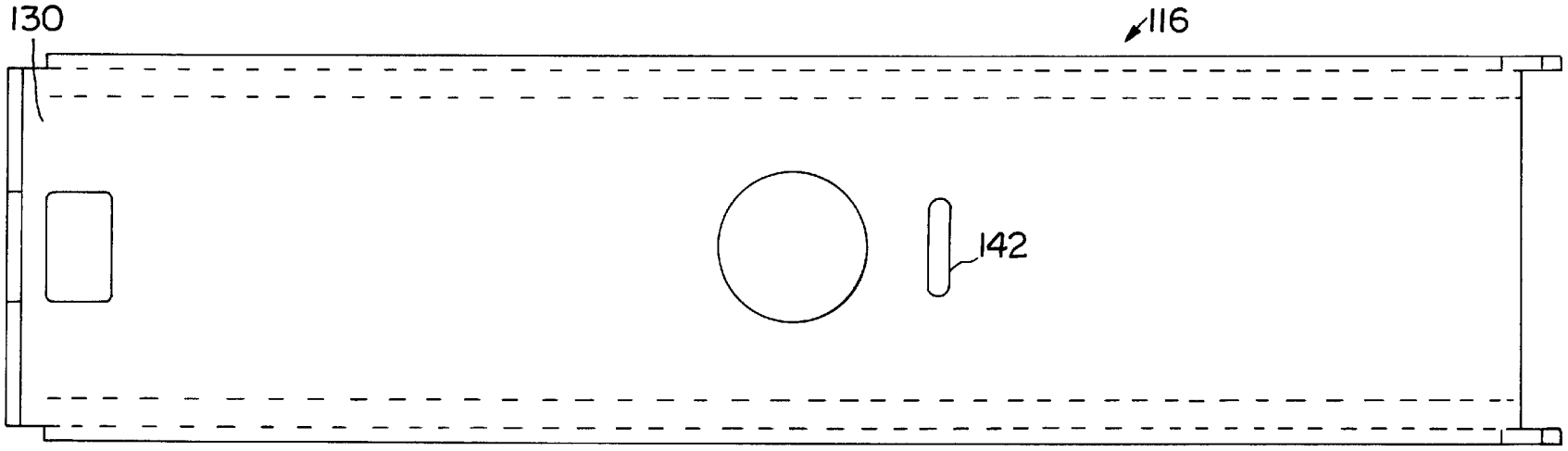
FIG. 7 is a plan view of the strongback.
Figure 6:
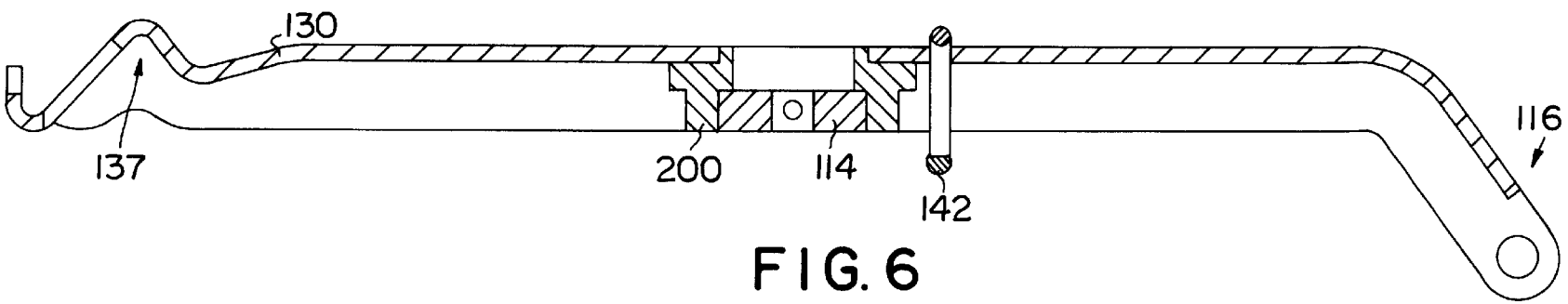
FIG. 6 is an enlarged longitudinal sectional view of the strongback.
Figure 8:
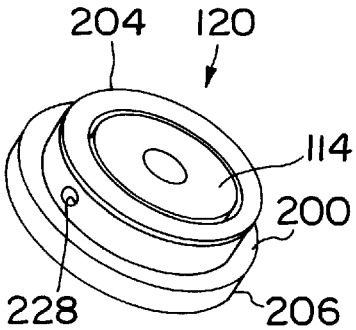
FIG. 8 is a perspective view of the flexible coupling.
Figure 9:
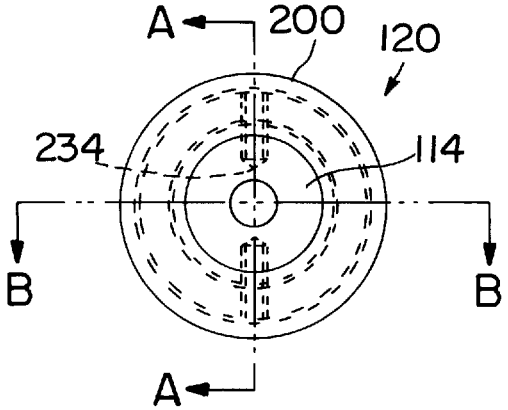
FIG. 9 is a plan view of the flexible coupling.
Figure 10:
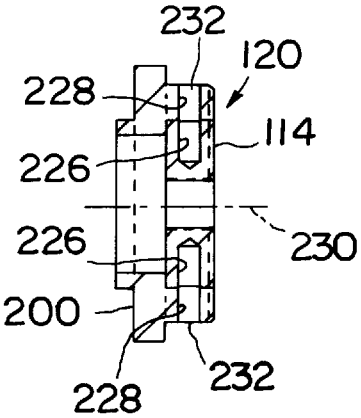
FIG. 10 is a sectional view thereof taken along lines A—A of FIG. 9.
Figure 11:
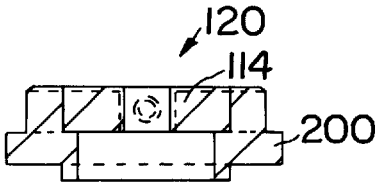
FIG. 11 is a sectional view thereof taken along lines B—B of FIG. 9.
Figure 12:
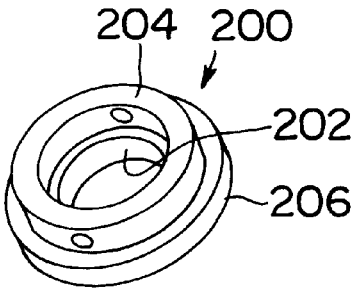
FIG. 12 is a perspective view of a support member for the flexible coupling.
Figure 13:
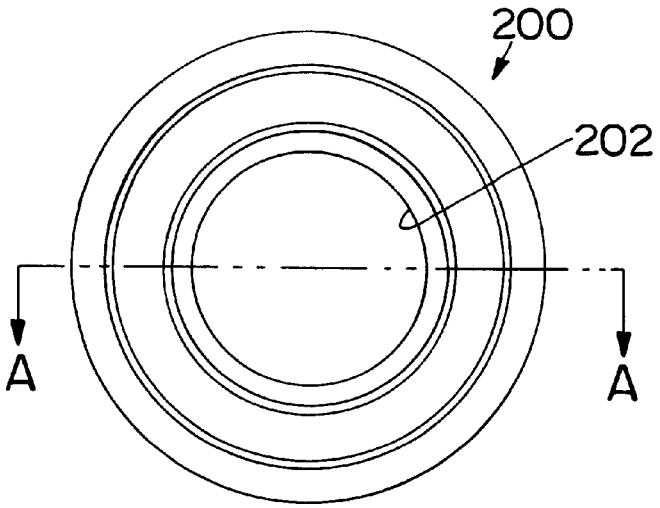
FIG. 13 is a plan view of the support member.
Figure 14:
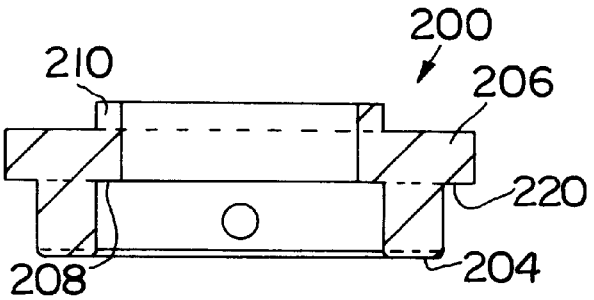
FIG. 14 is a sectional view thereof taken along lines A—A of FIG. 13.
Figure 15:
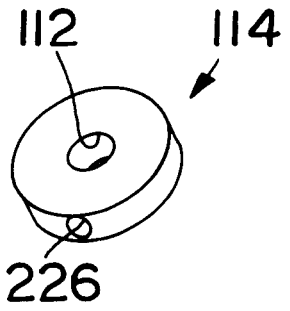
FIG. 15 is a perspective view of a swivel insert for the flexible coupling.
Figure 16:
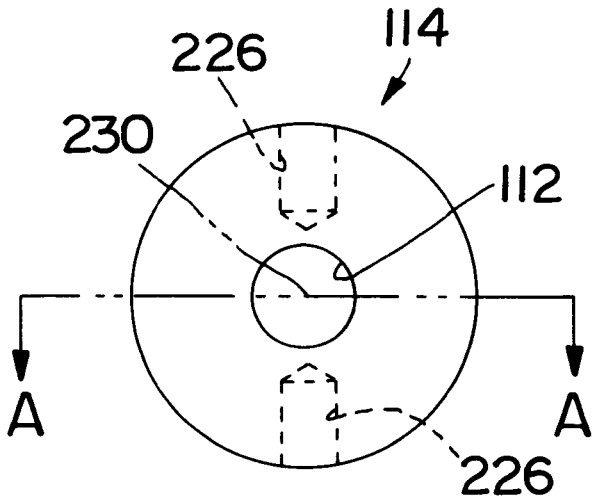
FIG. 16 is a plan view of the swivel insert.
Figure 17:
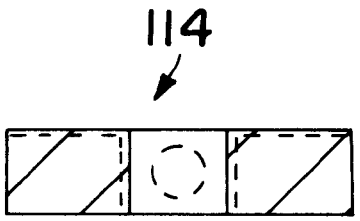
FIG. 17 is a sectional view thereof taken along lines A—A of FIG. 16.
Figure 19:
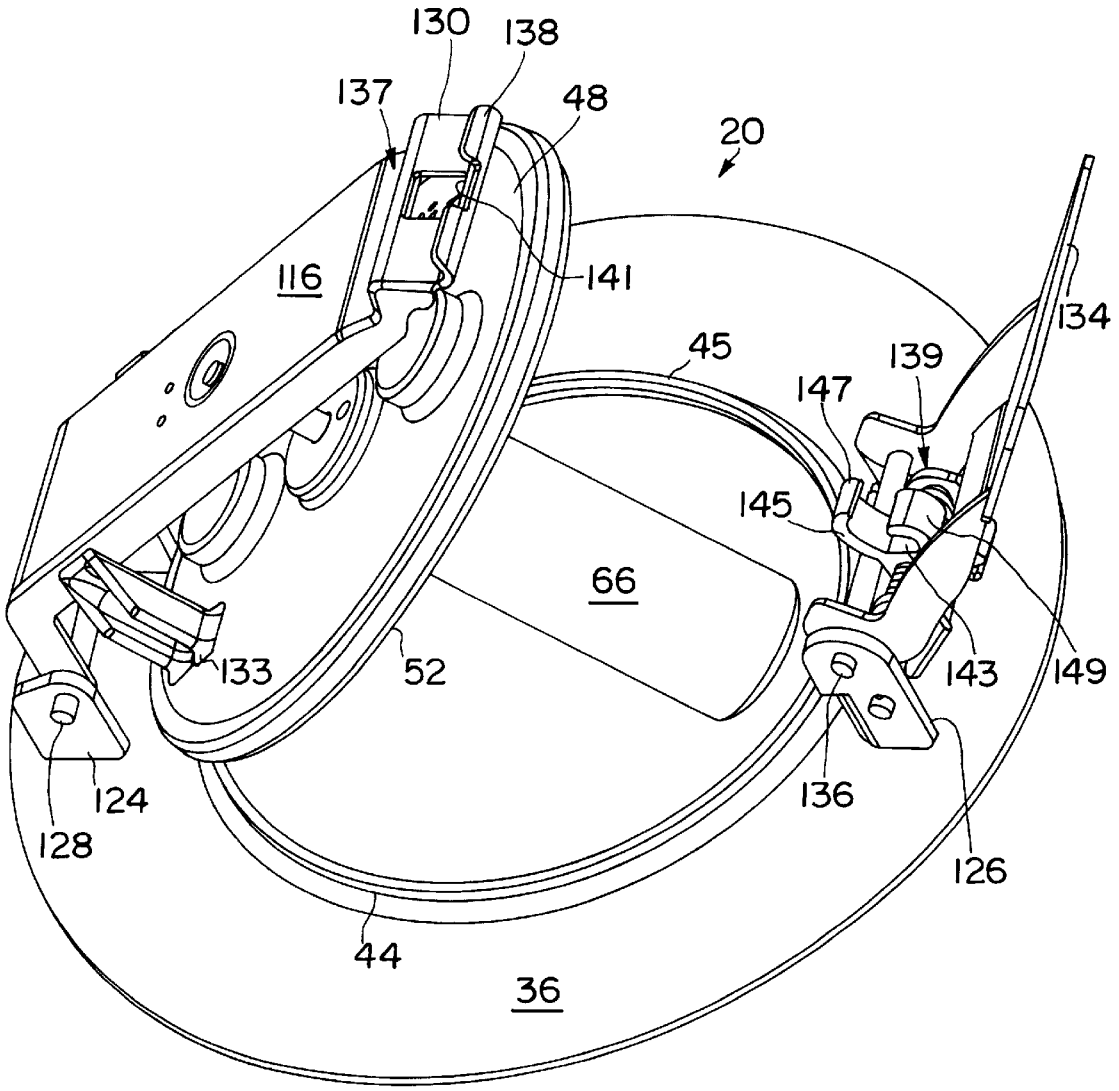
FIG. 19 is a schematic perspective of the filling and pressure relief assembly modified to include a self-latching assembly and to not include certain optional features (which are illustrated in FIG. 18) in the manhole plate.
Figure 21:
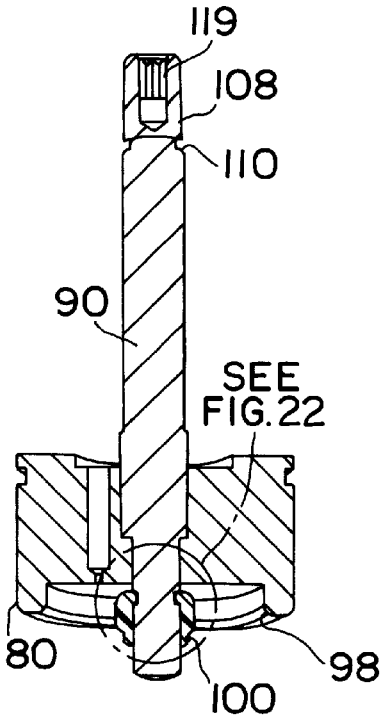
FIG. 21 is a longitudinal sectional view of a stem and piston for the filling and pressure relief assembly.
Figure 22:
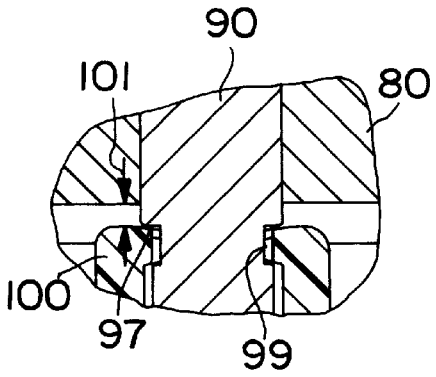
FIG. 22 is an enlarged view of a portion of the stem and piston.

The position of lever 116 is stabilized between a pair of brackets 133 which are suitably attached to the cover 48. To close the fill opening 46, the lever 116 is swung downwardly about pivot 128 so that the gasket 52 sealingly engages the seating surface 45 of flange 44, as seen in FIG. 1, and is held in this position, i.e., lockingly urged in this position, by an elongate cammed latch 134, which is pivotally mounted as by pivot rod 136 to bracket 126 for movement, as illustrated at 135 in FIG. 20, into position horizontally for holding the lever 116 down. The cammed portion on the latch 134 engages a recess, illustrated at 137, in the upper surface of the lever 116 to prevent upward movement of the lever. A safety catch 138 on the free end portion of the lever 116 catches on a lip 140 on the pivot end portion of the latch 134 in order to prevent inadvertent opening while the tank is under pressure. The lever 116 and latch 134 are components which are conventionally used for filling and pressure relief assemblies. A padlock loop 142, which is received in an opening 144 in the free end portion of the latch, may, if desired, be attached to the lever 116 for padlocking the filling and pressure relief assembly closed.

A self-latching assembly, illustrated at 139, may, if desired, be provided for latching the fill and pressure relief assembly closed in the event it is inadvertently left open. Thus, the lever 116 has a square opening, illustrated at 141, therethrough in its free end portion. The latch 134 has an annular member 143 comprising a first portion 145 having a lip 147 which extends radially outwardly of a second portion 149. Both portions 145 and 149 curve inwardly toward each other in what might be called a "spiral" configuration. During movement of a tanker, vibrations may cause the inadvertently raised lever 116 to fall downwardly toward the self-latching assembly 139. The kinetic energy generated by the falling lever 116 and cover 62 forces the lever 116 past the spring-loaded catch 149. The edge of this catch engages with the edge of the lever 116. At this engagement point, the lever 116 and accordingly the fill and pressure relief assembly is held down by the catch 149, with the latch 134 still in the vertical position. Portion 145 is a safety catch for engaging with the edge at 141 if the self-latching mechanism is released while there is pressure in the tank.

Plug member 74 is formed to have an inner upwardly extending cylindrical portion 146 which defines with the wall of cylinder 66 an annulus 148 in which is received one end portion of a spring 150. The other end portion of the spring 150 is received in piston recess 98. If the tank pressure 56 increases to a point above the set pressure, which is adjusted by adjusting the compression of spring 150, the tank pressure 56 will overcome the spring force and effect upward movement of the cover 48 and attached cylinder 66 whereby the gasket 52 disengages the flange 44 to relieve pressure in the tank (except in the event of a momentary pressure surge, as discussed hereinafter). When the tank pressure 56 drops below the set pressure, the spring force effects downward movement of the cylinder 66 and the cover 48 attached thereto so that the gasket 52 re-engages the flange 44 to close the opening 46.

A passage, illustrated at 152, having an orifice, illustrated at 154, extends through the piston 80 to provide regulated flow communication between the hole or annular space 84 above the piston 80 and the cylinder space, illustrated at 156, below the piston 80. A passage, illustrated at 158, extends through the cover 48 and has an inlet to the annular space 84. This passage 158 is closable by a plug 160. The entire cylinder space 156, the passage 152, and about half of the annular space 84 above the piston is filled with oil, illustrated at 162. This oil 162 is provided to cause the pressure relief and fill assembly to withstand a momentary pressure surge, which may be caused by, for example, a tank rollover accident, without opening. Thus, in the event of such a momentary surge, the incompressible oil completely filling the cylinder space 156 adds additional force which must be overcome so that the cover 48 is prevented from lifting. However, during sustained tank pressure 56 over the set pressure, the oil is flowed at a controlled rate, as determined by the orifice size, from the cylinder space 156 into the annular space 84 above the piston so that the cylinder may then move upwardly relative to the piston when the spring pressure is overcome and thus lift the cover to relieve the excess pressure. Oil is filled to about half the height of annular space 84; if it filled the entire annular space 84, it would undesirably act as a complete stop. When the tank pressure returns to normal and the cover gasket 52 is re-seated, the oil will flow by gravity and spring force back into the cylinder space 156 so that it is again completely filled with oil. The cylinder is entirely (to the level indicated at 162) charged with oil through opening 76. The passage 158 is used as a filling vent for the displaced air by the oil and also affords a means of sighting to determine when the annular space 84 is half filled. After the cylinder is charged, the plug 160 is installed, and the plug 78 is installed.

With the exception of the assembly 120 and the set pressure adjustment means (including gap 101) as so far described herein, the pressure relief and fill assembly 20 as so far described is conventional and can be constructed and used using principles commonly known to those of ordinary skill in the art to which this invention pertains.

It has been found that the set pressure in a conventional pressure relief and fill assembly may fluctuate, and some such conventional assemblies may not hold the required pressure. This problem may be caused by variations in the closure assembly (plate 36). Conventionally, the cover has been rigidly connected to the strongback. In such a conventional assembly, if the strongback were not perfectly square to the closure assembly, the cover may be forced at an angle to the closure assembly, as illustrated by phantom lines (opposite extreme position) in FIG. 4. As a result, the cover may undesirably be put into a "bind", and the cover gasket may not seal evenly on the closure assembly. This "bind" may also cause the cover gasket to rub at that pivot point and undesirably cause excessive wear.

In order to give the cover 48 flexibility to achieve the desired orientation so that the cover gasket 52 seals evenly on the closure flange 44 in addition to suitably supporting the cover, in accordance with the present invention, the conventional rigid connection of the stem 90 to the strongback 116 is replaced by the assembly 120, which is a flexible coupling. While the assembly 120 is shown and described hereinafter as a swivel assembly, it should be understood that it may be otherwise suitably constructed.

Figure 2:
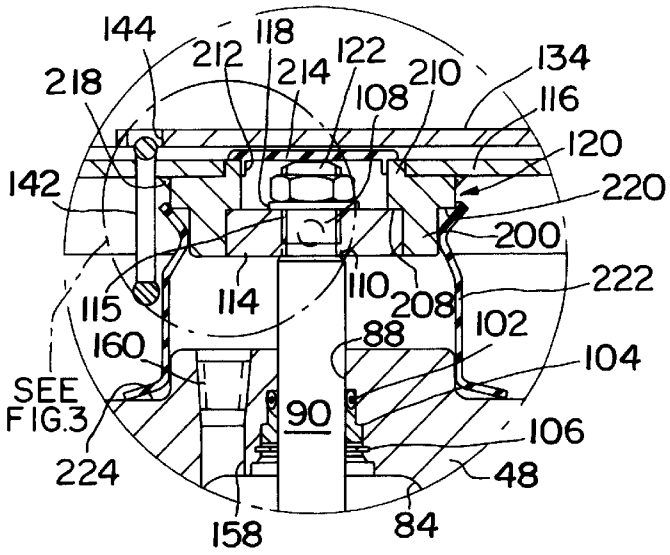
FIG. 2 is an enlarged view of a portion thereof as encircled in FIG. 1.
Figure 3:
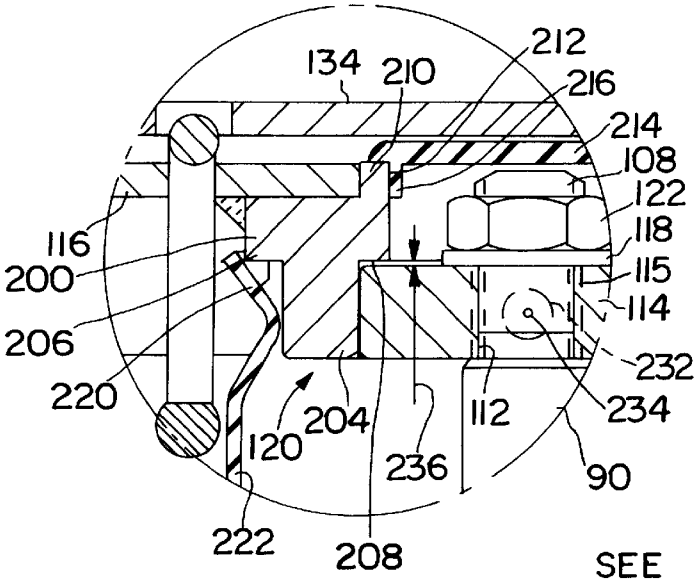
FIG. 3 is an enlarged view of a portion thereof as encircled in FIG. 2.
Figure 5:
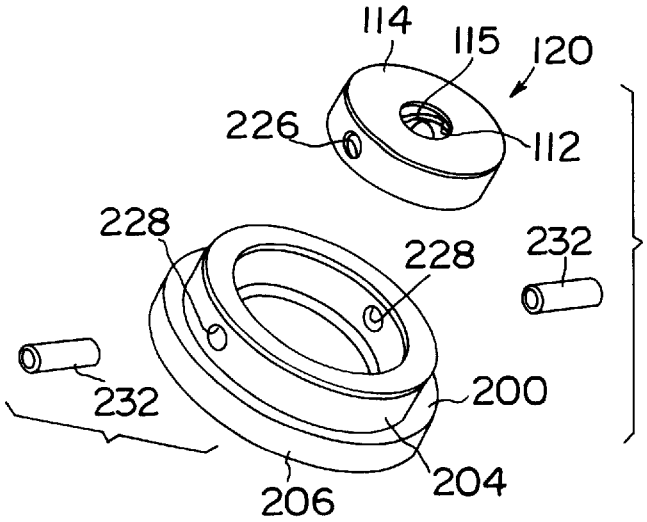
FIG. 5 is an exploded view of a flexible coupling for connecting a cover to a strongback thereof.

Flexible coupling 120, as best seen in FIGS. 3 and 5, comprises a support ring 200 having a bore 202. The ring has a lower portion 204 and an upper portion 206. The upper portion 206 has a decreased bore diameter thereby defining a shoulder 208. The ring 200 also has an upper cylindrical ridge extension 210 of the upper portion 206 which is received within a circular opening, illustrated at 212, in the lever 116 wherein access to the nut 122 is provided. This access is suitably enclosed by a plastic cap 214 which has a downwardly extending cylindrical portion 216 which is pressed into the bore 212. The support ring 200 is welded, as by welds 218, or otherwise suitably rigidly attached to the lever 116. The lower portion 204 has a reduced outer diameter thereby defining an annular notch, illustrated at 220, for supporting an upper end portion of an annular rubber baffle 222. The other end portion of the baffle is supported by an annular notch, illustrated at 224, in the upper surface of the cover 48. Thus, the baffle 222 is provided to surround the exposed part of the stem to keep dirt and the like therefrom.

Member 114 is a cylindrical insert which is received in the increased diameter bore portion of the lower ring portion 204. Its vertical movement is thus limited by the ring shoulder 208.

Insert 114 has a pair of diametrically opposed bores, illustrated at 226, which extend radially inwardly in a direction toward the insert axis, illustrated at 230, from the outer circumferential surface thereof and terminate short of aperture 112. Support ring 200 has a pair of corresponding diametrically opposed bores, illustrated at 228, which extend radially (in a direction toward the insert axis 230, which is also the ring axis) through the lower support member portion 204. The insert 114 is swivelly connected to the support ring 200 by a pair of spring pins 232 each of which is received in one of the bores 226 and the corresponding bore 228. The bores 226 and 228 and the pins 232 are suitably sized so that the pins 232 are press fit into the support ring bores 228 and are clearance fit in the insert bores 226 so that the insert 114 is free to swivel about the pins 232. The swivel assembly 120 is welded to the lever 116 so that the swivel axis, illustrated at 234 (which is the longitudinal axis of the pins 232), is parallel to the hinge or pivot axis 128 of the lever 116.

The swivel assembly 120 is sized and attached to provide a small gap, illustrated at 236, between the support ring shoulder 208 and the upper surface of the insert 114. This gap 236 may, for example, be about 0.015 inch to, along with play between the spring pins 232 and the insert 114, allow for approximately 4 degrees of rotation about the swivel axis 234. Slight movement normal to the swivel axis 234 may also occur. With the combination of these movements, a variation of a 360-degree wobble may be experienced. By a "swivel coupling" of the stem to the strongback is meant, for the purposes of this specification and the claims, a coupling which allows the stem to wobble or rock back and forth with respect to the strongback.

In addition to providing the strength required to support the pressure relief and filling assembly and to withstand pressure forces to which it may be subjected, the flexible coupling 120 is provided to allow the cover gasket 52 to "float" on the closure flange 44 just prior to closing the latch. This "floating" allows for adjustment to slight variations in the closure assembly. The cover is thus enabled to seal against the closure flange 44 more effectively by distributing the closing force evenly over the entire circumference of the cover gasket. Thus, the flexible coupling 120 is provided to eliminate binding of the cover against the closure flange and to more effectively provide the desired sealing. The flexible coupling 120 furthermore is provided to eliminate the "rub" of the cover gasket by allowing the cover to "drop" onto the closure flange 44 to thereby reduce wear on the cover gasket.

Accordingly, the flexible coupling of the present invention is provided for more effective sealing and reduced cover gasket wear than achieved in conventional pressure relief and fill assemblies.

Figure 23:
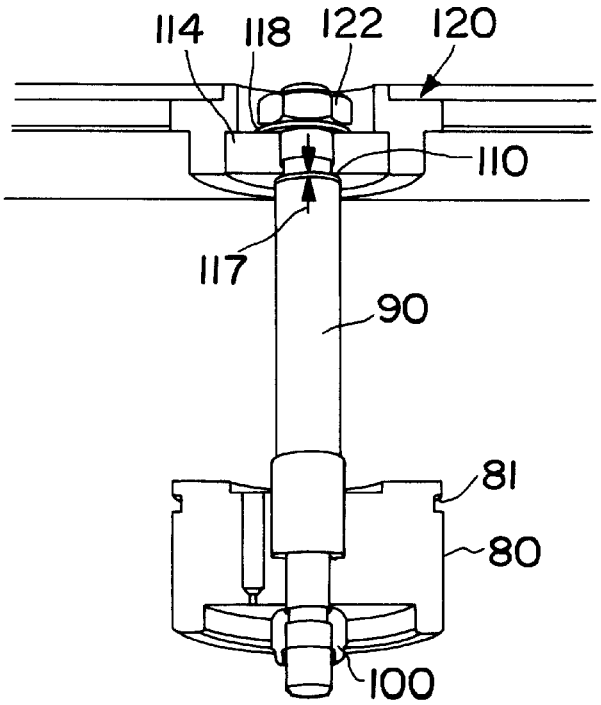
FIG. 23 is an elevation view of the stem, piston, flexible coupling, and strongback.

By adjusting the position of the piston 80 relative to the cylinder 66, the force exerted by the spring 150 may be adjusted to thereby adjust the set pressure, i.e., the pressure at which the pressure relief and fill assembly opens to relieve excess tank pressure 56. In accordance with the present invention, the threaded upper end portion 108 of the stem 90 is threadedly received in the flexible coupling insert aperture 112, which is accordingly threaded, as illustrated at 115, and the length of the portion 108 is such, for example, about 0.62 inch, as to allow a small gap, illustrated at 117, of, for example, up to about 0.05 inch, between the bottom of the insert 114 and the shoulder 110. In FIG. 23, the gap 117 is shown to be infinitely small and can be increased by rotation of the stem so that the shoulder 110 moves downwardly from the flexible coupling insert 114. The upper end of the stem 90 has a hex bore, illustrated at 119, for receiving an internal allen wrench hex for rotating the stem 90 thereby raising or lowering the stem 90 and accordingly the piston 80 (relative to the cylinder 66) by an amount up to the height of gap 117. By raising or lowering the piston 80 relative to the cylinder 66, the force exerted by spring 150 is decreased or increased respectively thus decreasing or increasing the set pressure respectively. Thus, the set pressure may be easily and conveniently adjusted without having to open the fill cover by loosening the nut 122, rotating the stem 90 by means of an allen wrench inserted in hex bore 119 to increase or decrease the gap 117 to achieve the desired set pressure, then retightening the nut 122 to maintain the adjusted position.

It should be understood that, while the present invention has been described in detail herein, the invention can be embodied otherwise without departing from the principles thereof, and such other embodiments are meant to come within the scope of the present invention as defined by the appended claims.

What is claimed is:

1. An assembly comprising means for closing an opening to a tank, said tank closing means including a cover member, means for sealingly seating said cover member in a position to close the tank opening, and means for lockingly urging said cover member to said closed position, said lockingly urging means including a plate, an elongate member having first and second end portions connected to said cover member and said plate respectively, means for pivotly mounting said plate to effect swinging of said plate and said cover member toward and away from the tank opening, means for locking said plate in a position overlying the tank opening, and means for evenly distributing seating force for sealingly seating said cover member when said cover member is swung into said position to close the tank opening with said plate overlying the tank opening, said seating force distributing means comprising means for flexibly coupling said second end portion of said elongate member to said plate.

2. An assembly according to claim 1 wherein said flexible coupling means comprises means for swivelly coupling said second end portion of said elongate member to said plate.

3. An assembly according to claim 2 wherein said swivel coupling means comprises a first ring member for receiving said second end portion of said elongate member, a second ring member attached to said plate for loosely receiving said first ring member, and pin means interconnecting said first and second ring members along a single axis and sized to allow relative rotation between at least one of said first and second ring members and said pin means.

4. An assembly according to claim 3 wherein said pin means comprises a pair of spring pins located on diametrically opposite sides of said second end portion of said elongate member.

5. An assembly according to claim 3 wherein said axis is parallel to a pivot axis of said plate.

6. An assembly according to claim 3 wherein said second end portion of said elongate member is threadedly attached to said first ring member.

7. An assembly according to claim 6 further comprising means for unseating said cover member to relieve excess pressure in the tank while said cover member is lockingly urged to said closed position, said pressure relief means comprising a cylinder having a terminal end portion and fixedly attached to said cover member to extend therefrom into the tank to terminate at said terminal end portion, a piston which is within and which is movable relative to said cylinder, said first end portion of said elongate member connected to said piston, means including a spring disposed within said cylinder between said piston and said terminal end portion for applying force to said terminal end portion to counter pressure within the tank urging unseating of said cover member.

8. An assembly according to claim 1 further comprising means for unseating said cover member to relieve excess pressure in the tank while said cover member is lockingly urged to said closed position, said pressure relief means comprising a cylinder having a terminal end portion and fixedly attached to said cover member to extend therefrom into the tank to terminate at said terminal end portion, a piston which is within and which is movable relative to said cylinder, said first end portion of said elongate member connected to said piston, means including a spring disposed within said cylinder between said piston and said terminal end portion for applying force to said terminal end portion to counter pressure within the tank urging unseating of said cover member, and the assembly further comprises means for adjusting the spring force.

9. An assembly comprising means for closing an opening to a tank, said tank closing means including a cover member, means for sealingly seating said cover member in a position to close the tank opening, and means for lockingly urging said cover member to said closed position and for unseating said cover member to relieve excess pressure in the tank while said cover member is lockingly urged to said closed position, said lockingly urging and pressure relieving means including a plate, a cylinder having a terminal end portion and fixedly attached to said cover member to extend therefrom into the tank to terminate at said terminal end portion, a piston which is within and which is movable relative to said cylinder, an elongate member having first and second end portions connected to said piston and said plate respectively, means including a spring disposed within said cylinder between said piston and said terminal end portion for applying force to said terminal end portion to counter pressure within the tank urging unseating of said cover member, and the assembly further comprises means for adjusting the spring force, said spring force adjusting means including thread means for connecting said second end portion of said elongate member to said plate.

10. An assembly according to claim 9 further comprising means including opening means in said plate for accessing said elongate member for turning thereof for adjusting the spring force.

11. An assembly according to claim 9 further comprising means for rotating said elongate member for adjusting the spring force without rotating the piston.

12. An assembly according to claim 9 further comprising means for preventing unseating of said cover member during a momentary pressure surge, said unseating preventing means comprising means defining an enclosed annular space above said cover member, means defining an orifice interconnecting said cylinder and said orifice means, and an incompressible fluid filling said cylinder and said orifice means and partially filling said annular space means.

13. An assembly according to claim 9 further comprising means for evenly distributing seating force for sealingly seating said cover member when said cover member is swung into said position to close the tank opening with said plate overlying the tank opening, said seating force distributing means comprising means for flexibly coupling said second end portion of said elongate member to said plate.

14. An assembly according to claim 13 wherein said flexible coupling means comprises means for swivelly coupling said second end portion of said elongate member to said plate.

15. An assembly according to claim 14 wherein said swivel coupling means comprises a first ring member for receiving said second end portion of said elongate member, a second ring member attached to said plate for loosely receiving said first ring member, and pin means interconnecting said first and second ring members along a single axis and sized to allow relative rotation between at least one of said first and second ring members and said pin means.

16. An assembly according to claim 15 wherein said pin means comprises a pair of spring pins located on diametrically opposite sides of said second end portion of said elongate member.

17. An assembly according to claim 15 wherein said axis is parallel to a pivot axis of said plate.

18. An assembly according to claim 15 wherein said second end portion of said elongate member is threadedly attached to said first ring member.

19. An assembly comprising a member having a central opening means shaped to define a flange, means for sealingly attaching said flanged member to a tank opening, means for closing said central opening means, said closing means including a cover member, means for sealingly seating said cover member on the flange, a plate overlying said cover member, an elongate member having first and second end portions connected to said cover member and said plate respectively, means for pivotly attaching one edge portion of said plate to said flanged member to effect swinging of said plate and said cover member toward and away from the central opening, means for securing an outer edge portion of said plate to said flanged member for lockingly urging said cover member to said seated position, a cylinder having a terminal end portion and fixedly attached to said cover member to extend therefrom into the tank to terminate at said terminal end portion, a piston which is within and which is movable relative to said cylinder, means including a spring disposed within said cylinder between said piston and said terminal end portion for applying force to said terminal end portion to counter pressure within the tank urging unseating of said cover member, and means for threadedly and flexibly coupling said second end portion of said elongate member to said plate.

20. An assembly according to claim 19 wherein said flexible coupling means comprises means for swivelly coupling said second end portion of said elongate member to said plate.

* * * * *